United States Patent [19]

Faymonville

[11] 4,048,838

[45] Sept. 20, 1977

[54] ARRANGEMENT FOR CONTROLLABLY RECIPROCATING A WORKPIECE GRIPPING ASSEMBLY OF A MULTI-STAGE PRESS

[75] Inventor: Ernst Faymonville, Duesseldorf-Wersten, Germany

[73] Assignee: Malmedie & Co. Maschinenfabrik, Dusseldorf, Germany

[21] Appl. No.: 738,869

[22] Filed: Nov. 4, 1976

[30] Foreign Application Priority Data

Nov. 4, 1975 Germany ..... 2549319

[51] Int. Cl.[2] ..... B21D 43/5

[52] U.S. Cl. ..... 72/405; 10/12 T

[58] Field of Search ..... 72/405, 421; 10/12 T, 10/11 T, 72 T, 76 T, 12.5

[56] References Cited

U.S. PATENT DOCUMENTS

| | | | |
|---|---|---|---|
| 3,165,766 | 1/1965 | Wisebaker | 10/76 T |
| 3,695,088 | 10/1972 | Alvi | 72/405 |
| 3,717,890 | 2/1973 | Weller | 10/12 T |

*Primary Examiner*—C.W. Lanham
*Assistant Examiner*—Gene P. Crosby

[57] ABSTRACT

A play-free positive reciprocation of a gripper-carrying cradle of a multi-stage press is described. A first drive shaft coupled to the main press drive has a contoured control cam disposed thereon, with the contoured surface of the disc being in constant engagement with a roller which is urged obliquely toward the axis of the first shaft. The roller is rotatably carried on a second shaft transverse to the first shaft. One end of the cradle is secured to the second shaft, while the opposite end is secured to the free end of a first elongated connecting rod that is pivotally mounted on the machine frame. A second identical connecting rod, also pivotally mounted in the frame, has its free end coupled to the second shaft. Upon a rotation of the control cam disc on the first shaft, the so-mounted cradle is positively reciprocated over each point of a flattened cyclic path, during which the grippers carried by the cradle execute workpiece-gripping and transfer movements in a conventional manner.

3 Claims, 2 Drawing Figures

ARRANGEMENT FOR CONTROLLABLY RECIPROCATING A WORKPIECE GRIPPING ASSEMBLY OF A MULTI-STAGE PRESS

BACKGROUND OF THE INVENTION

The invention relates to multi-stage presses and more particularly to facilities in such press for transversely moving a gripper-carrying cradle over a plurality of transversely spaced workpiece-receiving stations of the press in a cyclic path so that the grippers can be operated to transfer workpieces among the several stations.

Existing facilities of this general type have several disadvantages. Firstly, such designs have suffered from inaccuracies due to excessive play in the cradle drive. In addition, such facilities have been adapted to move the cradle along an essentially semicircular path, with a first portion of the cyclic movement of the cradle being positively driven along the path and the return movement being effected by the restoring force of resilient biasing means. The resultant high acceleration forces generated in a direction perpendicular to the desired transverse component of movement of the cradle with such arrangement necessitates the reduction in operating speed of the machine, and thereby of machine efficiency, in order to avoid excessive damage to the machine parts.

SUMMARY OF THE INVENTION

Such disadvantages are overcome with the improved gripper cradle drive of the present invention. In an illustrative embodiment, a control disc having a contoured axial camming surface is affixed to a first shaft which is coupled to the main machine shaft and which extends in a direction along which the several workpiece-receiving stations of the press are aligned. A roller is obliquely urged against the cam surface, and is rotatably supported on a second shaft which is generally transverse to the first shaft.

The first shaft, in turn, is secured to one end of the cradle, while the free end of a first elongated connecting rod, which is pivotally mounted at one end to the machine frame, is secured to the other end of the cradle.

A second identical connecting rod, which like the first rod is pivotally mounted at one end to the machine frame, is coupled at its free end to the second shaft, whereby a displacement of the roller by the axial camming surface of the control disc reciprocates the cradle in a flattened path. Because of the steady pressure of the roller against the camming surface, the cradle will be positively moved over each portion of a cyclic path during the rotation of the first shaft, and thereby the camming surface of the control disc. The steady pressure of the roller on the camming surface also assures a play-free operation of the cradle drive.

Preferably, the connecting rods associated with the cradle are of the same length, and are each longer than half the distance between adjacent work stations of the press, so that the flattened path of reciprocation of the cradle is slightly arcuate. Such feature tends to compensate for non-transverse components of movement of the individual grippers carried by the cradle when such grippers open following a workpiece-transfer operation.

BRIEF DESCRIPTION OF THE DRAWING

The invention is further set forth in the following detailed description taken in conjunction with the appended drawing, in which.

DETAILED DESCRIPTION

Figure 1:
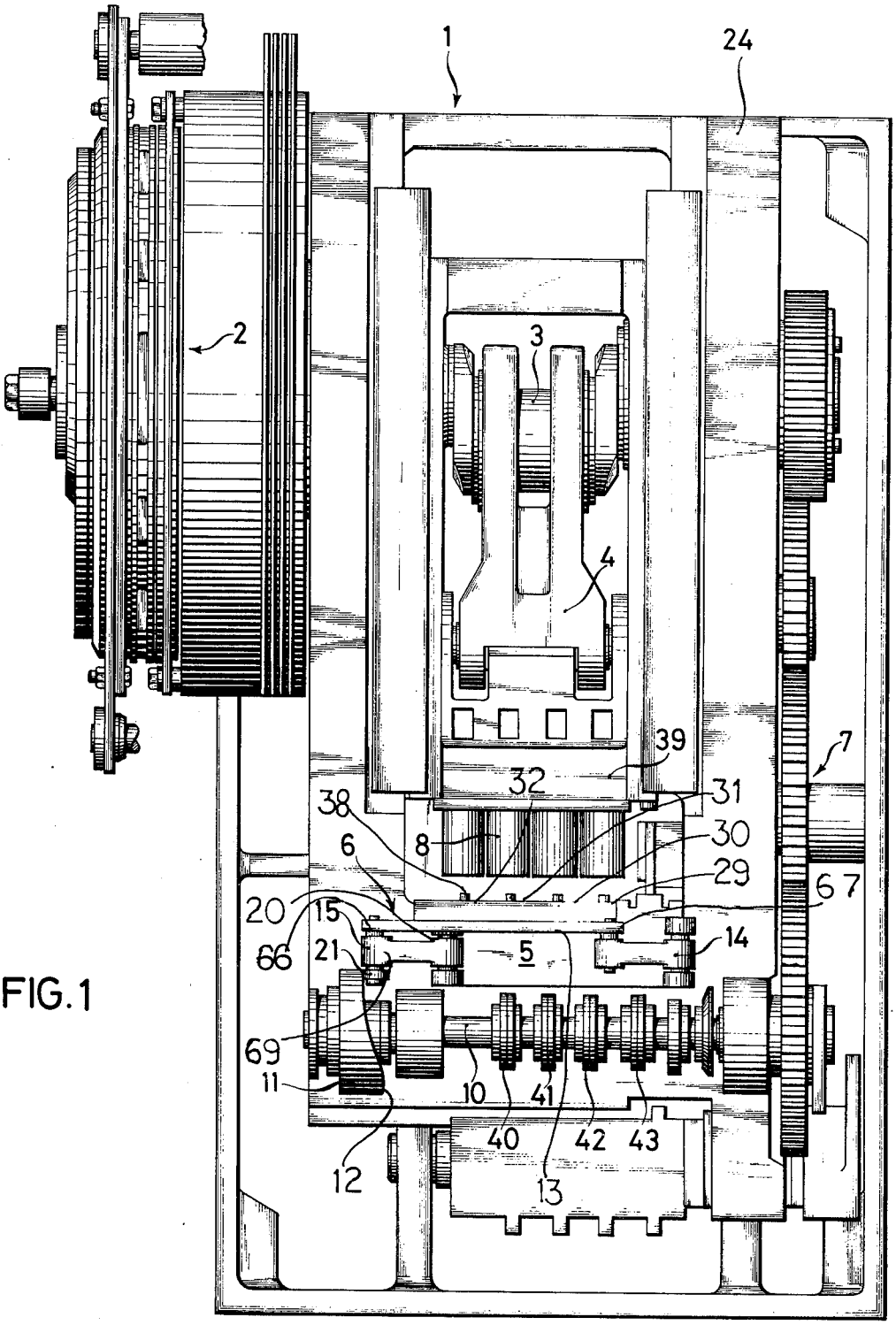
FIG. 1 is a top view of a portion of a multi-stage press having facilities for driving a gripper-carrying cradle in accordance with the invention.

Referring now to the drawing, the plan view of FIG. 1 illustrates a multi-stage press including a female or die portion 5 secured in a press housing 24. The die portion 5 includes a plurality of conventional, transversely spaced and aligned workpiece holding stations 29, 30, 31 and 32. The stations 29-32 are positioned opposite corresponding pressing sections 8, which may be successively actuated to execute one of a succession of steps in converting a workpiece (indicated at 38) held in the appropriate station into a screw, bolt or the like.

The successive pressing sections 8 may be operated in a conventional manner by means of a timed drive 39, which in turn is linked to a connecting rod 4 associated with a main press crankshaft 3. The crankshaft 3 may, in turn, be associated with a suitable prime mover (not shown) via a coupling section 2.

As each stage in the forming of the workpiece 38 takes place, a suitable one of a plurality of gripping elements 16-19 (FIG. 2) may be actuated to transfer the workpiece to the next one of the stations 29-32 for further working by the opposed press section 8. The gripping sections 16-19 are supported on a transeversely movable carriage 13.

Figure 2:
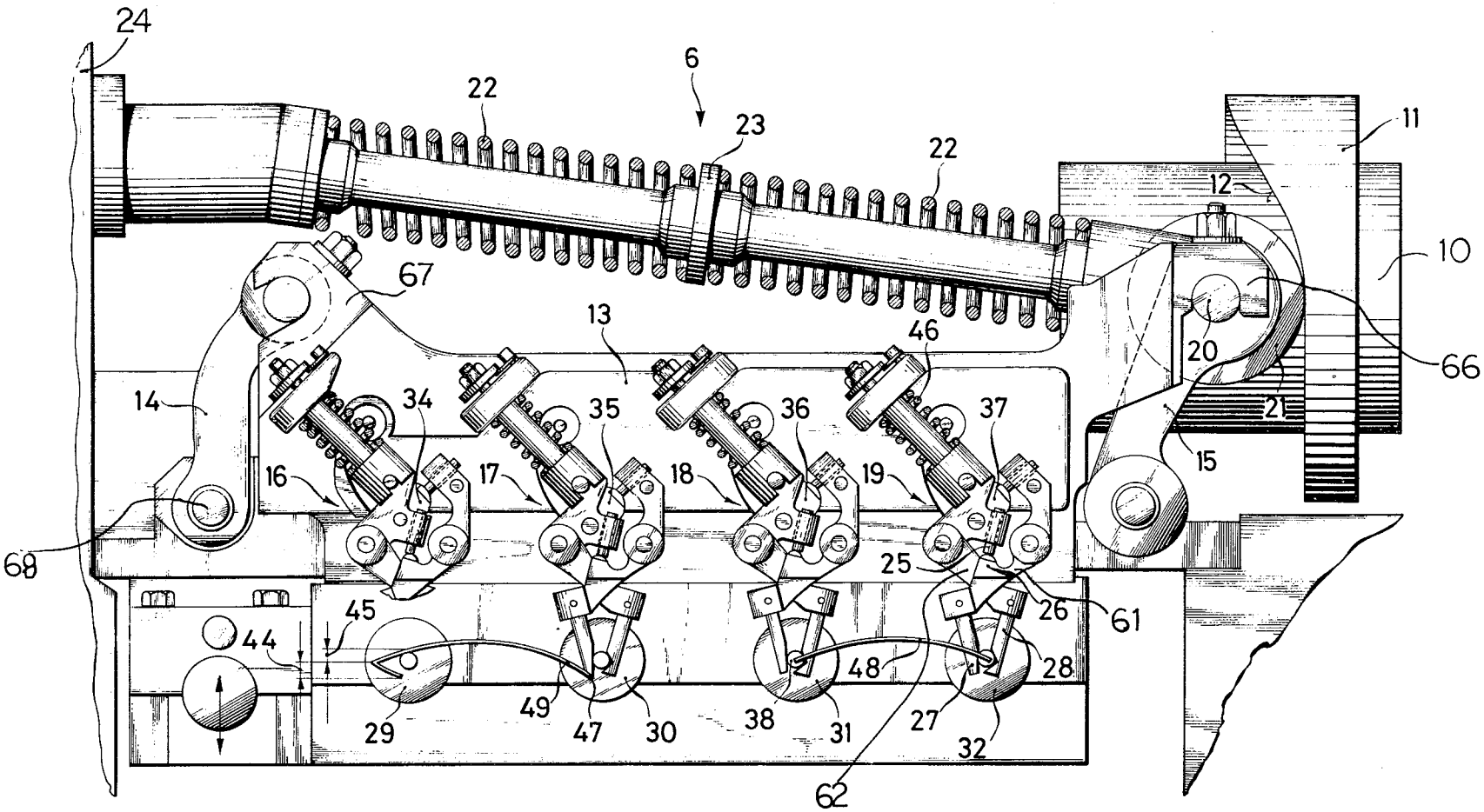
FIG. 2 is a front view, in enlarged form, of a portion of the press of FIG. 1 associated with the cradle drive.

Each of the gripping elements 16-19 includes a pair of legs 27, 28 which are dependent from coupled levers 61, 62, respectively. The legs 27, 28 are normally biased into workpiece-gripping relation as indicated in FIG. 2 by means of a biasing spring 46.

During a typical cycle of transverse reciprocation of the carriage 13 by means of the facilities to be described below, the gripping elements 16-19 are selectively operated from the workpiece-gripping position to an open position, in which the gripped workpiece is released. Conventionally, the opening of the legs 27, 28 occurs after the workpiece has been moved by the gripper member to the next-succeeding station. The manner of operating the gripper members is entirely conventional, and illustratively includes an associated plurality of opening cams 40-43 (FIG. 1) which are secured to a shaft 10 that is coupled to the main crankshaft 3 through a gear train 7. The opening cams 40-43 operate levers 34-37 (FIG. 2) and thumbwheel-like cam drives 25, 26, which simultaneously move the levers 61, 62 to open the legs 27, 28 at the appropriate time. Again, the structure of the gripping elements 16-19 and the manner of operating them are familiar to those skilled in the art and will not be discussed further here.

In order to reciprocate the carriage 13 to instrument a workpiece-transfer operation of the above-mentioned type, the drive portion represented generally at 6 is provided. The portion 6 includes a control disc 12, which is secured to the shaft 10 (FIG. 2) and has an axially contoured front camming surface 12. A roller 21 is constantly urged against the surface 12 by means of a biasing spring 22, which is supported around a mandrel 23 that extends outwardly from a portion of the frame 24. As indicated, the mandrel 23 extends at an acute angle to the axis of the shaft 10. Such oblique incidence have been found to improve th contact between the roller 21 and the cam 12.

The roller 21 is rotatably supported on one end of a shaft 20 which extends generally perpendicular to the shaft 10. An end portion 66 of the carriage 13 is secured to the other end of the shaft 21. An opposite end portion 67 of the carriage 13 is secured to a free end of a first connecting rod 14, whose other end is pivotally mounted, as by a pin 68 in the frame 24.

A second connecting rod 15, identical in length to the first rod 14, is associated with the end 66 of the carriage 13, and has an outer end 69 (FIG. 1) coupled to an intermediate portion of the shaft 20, thereby completing the driving coupling between the shaft 10 and the carriage 13.

In the operation of the drive 6, a rotation of the main crankshaft 3 of the press 1 (FIG. 1) will correspondingly rotate the shaft 10 via the gear train 7. The corresponding rotation of the control disc 12 will present successive portions of the axially contoured surface 12 of the disc 11 in contacting relation to the roller 21, which will in turn impart a movement to the connecting rod 15, and thereby to the rod 14 and the carriage 13. Because of the constant pressure of the roller 21 on the moving cam surface 12, each point of rotation of the surface 12 will lead to a corresponding positive movement in the path or reciprocation of the carriage 13, so that play in the latter structure will be eliminated. The contour of the reciprocatory path of the carriage 13 is generally flat, and its precise nature will be determined by the relation between the length of the connecting rods 14, 15 and the transverse distance between successive ones of the work stations 29–32. Advantageously, each of the rods 14 and 15 has a length which is greater than one half the distance between such successive stations, thereby imparting a slight upward curvature to the carriage path. Illustratively, the amplitude of such curvature corresponds to a dimension represented at 45 in FIG. 1; such amplitude is chosen to approximately compensate for the downward movement, represented by 44, of the legs 27 of the gripping members 16–19 when the legs 27, 28 are opened.

If desired, a plurality of curved guide plates 48, 49 may extend between selected successive ones of the work stations 29–32 to guide the legs 27, 28 of the gripping members along the arcuate path dictated by the slight upward curvature of the path of reciprocation exhibit by the carriage 13.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a multi-stage press, a plurality of aligned, workpiece-holding first stations spaced along a first direction and supported in the frame, a first shaft rotatably supported in the frame, a first control disc secured to the first shaft and having an axially contoured front surface, an elongated carriage extending in a first plane over the first stations for supporting a plurality of selectively operable gripper means to engage and transport workpieces between successive ones of the first stations, a second shaft, a roller supported on the second shaft, means for connecting one end of the carriage to the second shaft, first and second elongated connecting rods having corresponding first and second ends, means for coupling the first end of the first rod to the second shaft, means for connecting the other end of the carriage to the first end of the second rod, means for individually pivotally mounting the second ends of the first and second connecting rods to the frame, means for urging the roller into steady contact with the contoured front surface of the control disc whereby the rotation of the first shaft about its axis will cause a positive movement of the carriage along a reciprocatory path in the first plane corresponding to each point of movement of the control disc about its axis with a minimum of play, and means for rotating the first shaft about its axis.

2. A press as defined in claim 1, in which the urging means comprises, in combination, an elongated element extending from the frame obliquely toward the front surface of the control disc at an acute angle to the first axis, the element having a front end terminating on the opposite side of the roller from the front surface, and a biasing spring supported around the element and extending from the frame to the adjacent surface of the roller for biasing the roller continually toward the front surface of the control disc.

3. A press as defined in claim 1, in which the length of the first and second connecting rods are identical and are each greater than one half the distance between adjacent ones of the first stations.

* * * * *